US006385780B1

(12) United States Patent
Racine

(10) Patent No.: US 6,385,780 B1
(45) Date of Patent: May 14, 2002

(54) PROTECTIVE HELMET WITH ADJUSTABLE PADDING

(75) Inventor: Bertrand Racine, Montréal (CA)

(73) Assignee: Bauer Nike Hockey Inc., St-Jérôme (CA)

( * ) Notice: Subject to any disclaimer, the term of this patent is extended or adjusted under 35 U.S.C. 154(b) by 0 days.

(21) Appl. No.: 09/953,170

(22) Filed: Sep. 17, 2001

(30) Foreign Application Priority Data

Sep. 28, 2000 (CA) ..... 2321399

(51) Int. Cl.[7] ..... A42B 3/00; A42B 1/22
(52) U.S. Cl. ..... 2/414; 2/418
(58) Field of Search ..... 2/411, 414, 418, 2/417, 419, 412, 425

(56) References Cited

U.S. PATENT DOCUMENTS

| | | | | | |
|---|---|---|---|---|---|
| 3,344,433 | A | * | 10/1967 | Stapenhill | 2/420 |
| 3,579,637 | A | * | 5/1971 | Aileo | 2/418 |
| 3,820,163 | A | | 6/1974 | Rappleyea | |
| 4,282,610 | A | | 8/1981 | Steigerwald et al. | |
| 4,404,690 | A | * | 9/1983 | Farquharson | 2/420 |
| 4,477,929 | A | * | 10/1984 | Mattsson | 2/417 |
| 4,827,537 | A | | 5/1989 | Villa | |
| 4,903,346 | A | * | 2/1990 | Reddemann et al. | 2/411 |
| 5,012,533 | A | | 5/1991 | Raffler | |
| 5,272,773 | A | | 12/1993 | Kamata | |
| 5,511,520 | A | | 4/1996 | Regueiro | |
| 5,628,071 | A | | 5/1997 | Nezer | |
| 6,108,824 | A | * | 8/2000 | Fournier et al. | 2/418 |
| 6,202,223 | B1 | * | 3/2001 | Chartrand | 2/410 |
| 6,298,497 | B1 | * | 10/2001 | Chartrand | 2/414 |
| 6,324,700 | B1 | * | 12/2001 | McDougall | 2/414 |

FOREIGN PATENT DOCUMENTS

EP 0 346 608 A2 6/1989

* cited by examiner

*Primary Examiner*—Rodney M. Lindsey

(57) ABSTRACT

An adjustable protective helmet for sporting activities comprising a first and second shell component, each having respective cooperating overlapping segments extending transversely across the top portion of the wearer's head for connecting together to form a helmet shell assembly circumscribing the wearer's head. The shells are movable relative to one another in the overlapping segments to provide size adjustability of the helmet. The protective helmet includes a shock absorbing pad assembly inside comprising at least two padding sections, one padding section comprising an opening, the other padding section comprising an extension loosely fitting within the opening and shaped to allow relative longitudinal motion between the padding sections; the padding sections further comprising stopping means to limit the relative longitudinal motion between them.

22 Claims, 10 Drawing Sheets

PROTECTIVE HELMET WITH ADJUSTABLE PADDING

FIELD OF THE INVENTION

The present invention relates to a protective helmet for sporting activities such as hockey and more particularly, to a protective helmet having a novel adjustable internal padding for use by hockey players.

BACKGROUND OF THE INVENTION

Protective helmets comprising adjustability features are well known. In this regard, it is known to provide an adjustable helmet having two shell portions held together by screws. The loosening and tightening of the screws allow for adjustment of the helmet size. In use, the two shell portions are fixedly held together by fasteners such as screws. The shells are thus adapted to move relative to one another when the fasteners are loosened. When the desired size is obtained, the fasteners are tightened and the two shell portions are locked in place. The two shell portions usually have overlapping surfaces to enable the shell portions to be moved relative to one another while not leaving any gap between the two shell portions. A protective helmet's main task is to spread the force of impact to as wide a surface as possible in order to absorb impact and prevent injuries to the cranium.

Conventional protective helmets have one or more inner pads secured by fasteners to the inner surfaces of the shell portions and are generally adapted to conform to the shape of a wearer's head. Shock-absorbing padding is positioned inside the helmet shell to cushion the wearer's head. For practical reasons, there are usually two sections of padding: One section of padding being attached to each shell portion of the protective helmet. This arrangement simplifies the assembly of padding and shell portions and also facilitates assembly of the components.

One drawback of this known configuration is that a gap is created between the two sections of padding, which coincides with the overlapping surfaces of the shell portions. More particularly, one of the problems associated with such a configuration arises when the protective helmet is adjusted to its largest head size. Since for adjustability purposes, the sections of padding must be designed to fit within the helmet shell when the latter is adjusted to its smallest head size without having overlapping padding material which would make the protective helmet uncomfortable, a gap between the two sections of padding may arise when the helmet is adjusted to its largest possible head size and this may provide a zone of discomfort for the wearer. Bauer Inc. has introduced a protective helmet with self-adjusting padding which is fully disclosed in PCT patent application, CA97/00905, published Jun. 4, 1998 under international publication number WO98/23174. The helmet disclosed provides for three sections of padding of which a central section is slidably connected to the two adjacent sections without being fastened to the outer helmet shell. When the size of the helmet is adjusted, the central section remains substantially in the center portion of the helmet, effectively splitting the normal resulting gap into two distinct zones on either sides of the central section. However, since the central section is loose, it may end up resting further to the rear or to the front of the helmet, leaving a larger gap on one side than the other.

Thus there is a need for an improved adjustable protective helmet which alleviates some of these shortcomings and provides optimum comfort and good protection through the full range of adjustment.

OBJECTS AND STATEMENT OF THE INVENTION

It is therefore an object of the invention to provide an adjustable protective helmet having an improved shock absorbing padding assembly, which overcomes some of the disadvantages of the prior art.

It is another object of the invention to provide an adjustable protective helmet having an improved shock absorbing padding assembly, which is adapted to minimize the gaps between padding sections.

As embodied and broadly described herein, the invention provides an adjustable protective helmet for sporting activities comprising a helmet shell circumscribing the wearer's head being made of a molded front shell component and of a molded rear shell component. The front and rear shell components have respective cooperating overlapping segments for connecting them together to form said helmet shell. The front and rear shell components are movable relative to one another in the overlapping segments to provide size adjustability of the protective helmet. The protective helmet includes as a separate component a shock absorbing pad assembly retained inside the helmet shell; the pad assembly comprising: at least two juxtaposed padding sections; one of the at least two padding sections comprising an opening; the other of the at least two padding sections comprising an extension loosely fitting within the opening and shaped to allow relative longitudinal motion between the at least two juxtaposed padding sections. The at least two juxtaposed padding sections comprises motion-limiting means to limit the relative longitudinal motion and control the position of the extension relative to the opening.

Advantageously, the motion-limiting means comprises abutment of a portion of the extension with a portion of the opening. The extension comprises a wider end portion and the opening comprises a constriction which confines the wider end portion to the opening.

In a preferred embodiment, one of the at least two padding sections is a front padding section fixedly retained against displacement relative to the front shell component; and the front padding section comprises the opening. Furthermore, the extension also comprises a tongue protruding from at least one end of the extension, the tongue having a length sufficient to overlap a portion of an adjacent padding section.

As embodied and broadly described herein, the invention also provides an adjustable protective helmet for sporting activities comprising a helmet shell circumscribing the wearer's head, the helmet shell made of a molded front shell component and a molded rear shell component. Each shell component having respective cooperating overlapping segments for connecting together the front and rear shell components to form the helmet shell. The shell components are movable relative to one another in the overlapping segments to provide size adjustability of the protective helmet. The protective helmet includes a shock absorbing pad assembly inside the helmet shell; the pad assembly comprising a front padding section, a rear padding section and an central padding section positioned between the front and rear padding sections. The front padding section comprises an opening in an upper portion of the front padding section; the central padding section comprising an extension loosely fitting within the opening and shaped to allow relative longitudinal motion between the front and central padding sections. The front and central padding sections comprise motion-limiting means to limit the relative longitudinal motion and control the position of the central padding section relative to the front and rear padding sections.

Advantageously, the motion-limiting means comprises abutment of a portion of the extension with a portion of the opening. The extension comprises a wider end portion and the opening comprises a constriction, which confines the wider end portion to the opening.

In a preferred embodiment, the central padding section also comprises a tongue protruding from at least one end of the extension, the tongue having a length sufficient to overlap a portion of an adjacent padding section.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
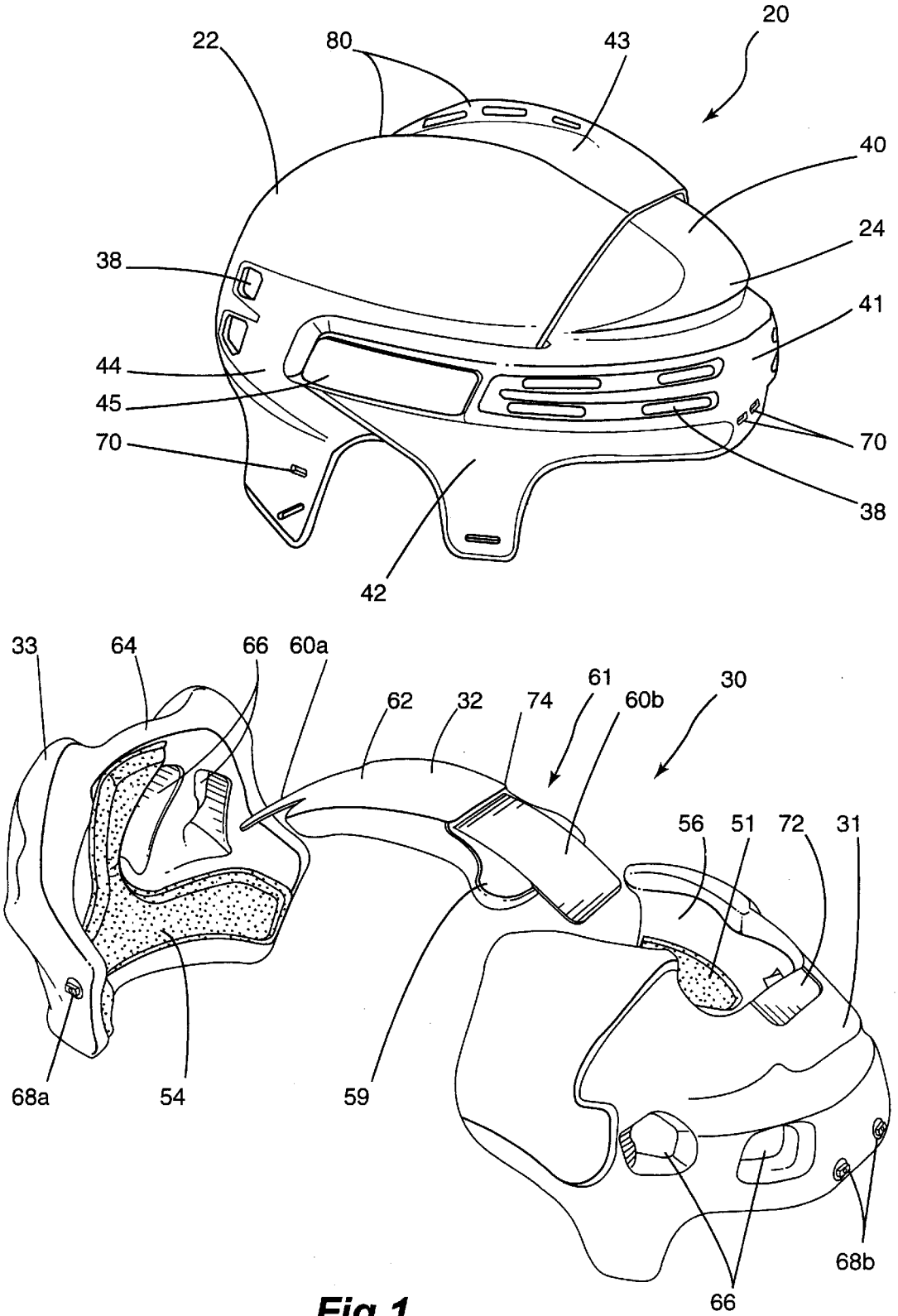
FIG. 1 is a perspective view of an adjustable protective helmet shell and its corresponding inner shock absorbing pad assembly in exploded view removed from the protective helmet shell according to a first embodiment of the invention.
Figure 2:
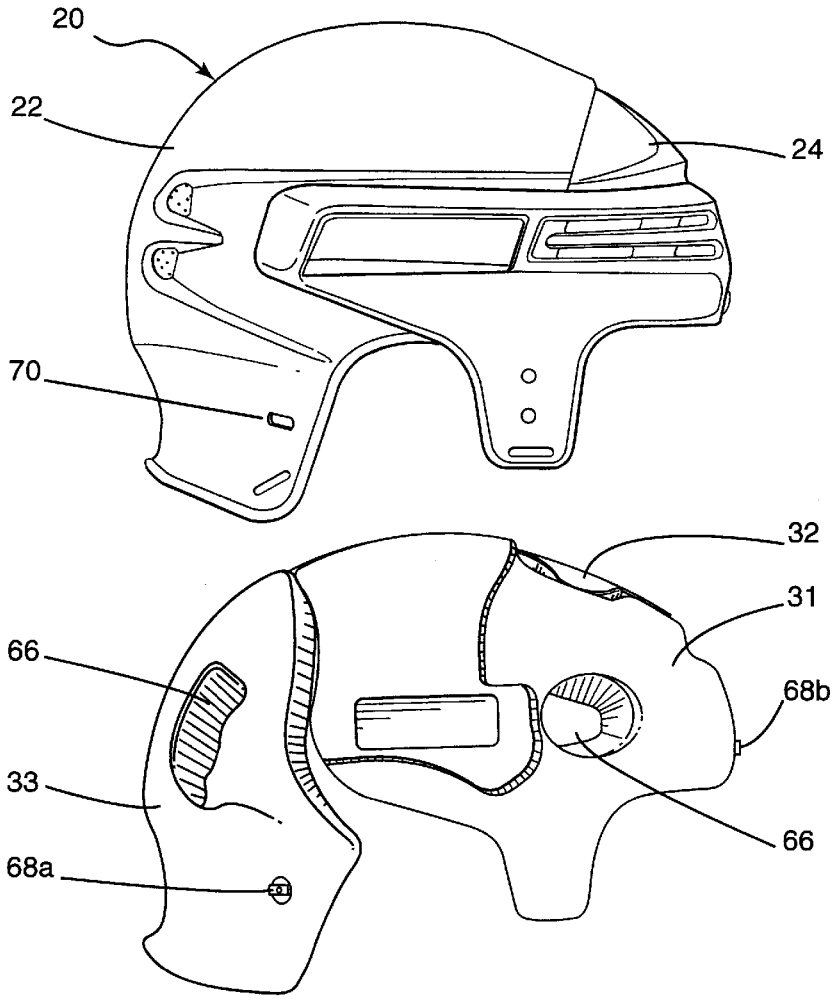
FIG. 2 is a side elevational view of the protective helmet shell and its corresponding inner shock absorbing pad assembly shown in FIG. 1 removed from the protective helmet shell.
Figure 3:
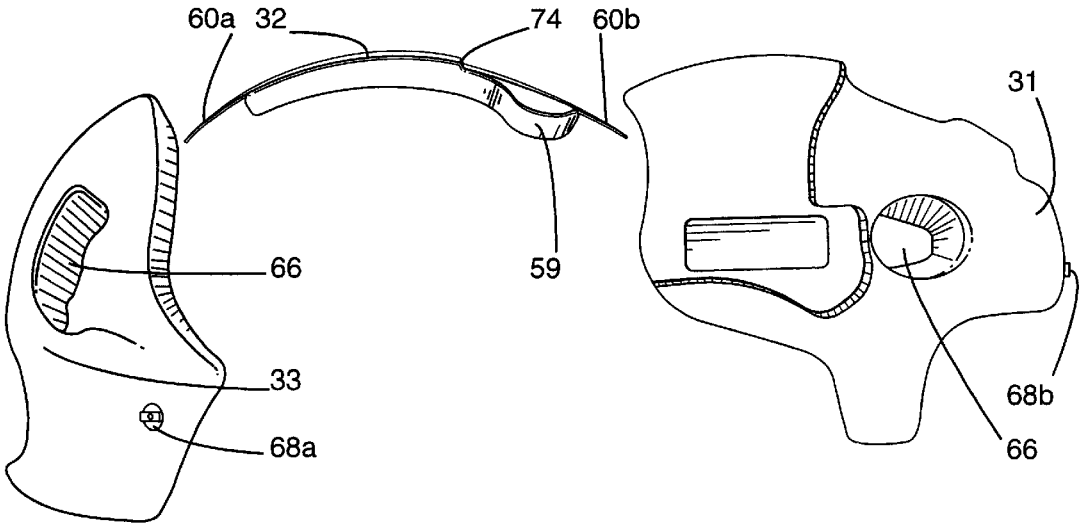
FIG. 3 is an exploded side elevational view of the inner shock absorbing pad assembly shown in FIGS. 1 and 2.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIGS. 1–7*b* illustrates a first embodiment of an adjustable protective helmet comprising a molded rear shell component 22 and a molded front shell component 24 interlocked together to form a protective helmet shell assembly 20 circumscribing the wearer's head. Front shell component 24 covers the forehead and a portion of the sides of a wearer's head, while rear shell component 22 covers the top, back and a portion of the sides of a wearer's head. Front and rear shell components 22 and 24 are movable relative to one another as described hereinafter.

Front shell component 24 comprises a top wall portion 40 and a frontal portion 41 that extends into side portions 42 covering the sides of helmet shell 20. Rear shell component 22 comprises a top wall portion 43 and side portions 44 covering the lateral portion of the head as well as the occipital region of the cranium. Rear shell component 22 further comprises a pair of elevated crest 80 extending from the forward edge of rear shell component 22 to the rear occipital region of rear shell component 22. Front and rear shell components 22 and 24 may also feature air vents 38 to provide adequate ventilation to help cool the wearer's head. Front and rear shell components 22 and 24 are preferably made of suitable impact resistant material such as polyethylene, polycarbonate alloy or other suitable plastic material.

As shown in FIG. 1, When front and rear shell components 22 and 24 engage one another, top wall portion 40 of front shell component 24 is located underneath top wall portion 43 of rear shell component 22 while the side portions 42 of front shell component 24 are located over the side portions 44 of rear shell component 22. Front and rear shell components 22 and 24 are locked together using screws or other suitable fastening means (not shown) located underneath panel 45 on each side of helmet shell assembly 20 thereby fastening together side portions 42 and 44. Panel 45 is hinged to side portion 42 for ease of access to the fastening means. Various types of fastening means such as a cam and lever assembly combined with a plurality of corresponding teeth on the internal surface of each side portions 42 and the external surface of each side portions 44 which lock together when pressed together by the cam and lever assembly, may also be used. Other mechanical links are possible as is well known in the art. Front and rear shell components 22 and 24 are adapted to move relative to one another when the fastening means is loosened. Shell components 22 and 24 are slidably adjusted to a minimum or maximum size and any position in between. When the desired helmet size is reached, the fastening means are tightened and front and rear shell components 22 and 24 are locked in place.

As shown at the bottom of FIG. 1, the protective helmet also comprises a shock absorbing pad assembly 30 which is normally installed inside shell assembly 20 but is here shown removed from helmet shell 20 for clarity. Shock absorbing pad assembly 30 comprises a front padding section 31, a central padding section 32 and a rear padding section 33. Pad assembly 30 is positioned inside helmet shell 20 to dissipate forces applied against helmet shell 20 thereby protecting the wearer's head. It is preferred that the front padding section 31, the central padding section 32 and the rear padding section 33 together cover substantially the entire inner surface of helmet shell 20. The external surface of each padding section 31, 32 and 33 is shaped to substantially conform to the inner surface of helmet shell 20.

Figure 4:
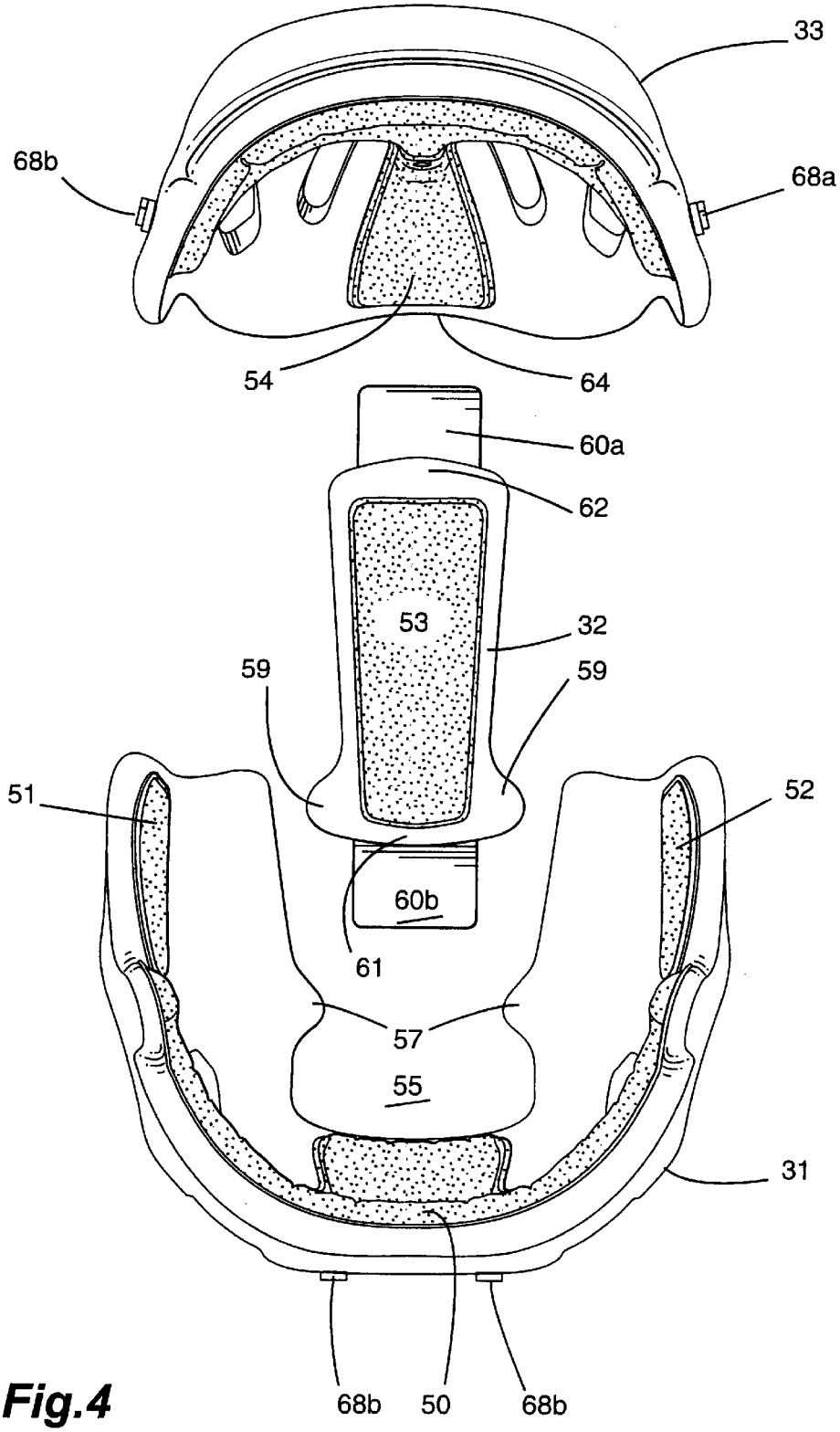
FIG. 4 is an exploded bottom plan view of the inner shock absorbing pad assembly shown in FIGS. 1, 2 and 3.

Each padding section 31, 32 and 33 preferably further comprises a second soft inner pad assembly as best seen in FIG. 4 which is glued to the interior surface of each padding section. A soft liner 50 covers the forehead portion of front padding section 31 and two small soft liner 51 and 52 cover the temple area. A soft liner 53 is glued to central padding section 32 and a soft liner 54 covering the lower cranium area and the central portion of rear padding section 33. Although, preferably glued to the padding sections, the soft inner liner may also be mechanically attached by hoop and loop type fasteners. The soft inner liners are not essential but provide added comfort to the wearer's head.

The padding sections 31, 32, and 33 are usually formed from any resilient moldable shock absorbing materials such as a foamed stryrene polymer, a foamed urethane polymer or other foam-like material being light in weight and having shock absorbing properties. A preferred material for padding sections 31, 32, and 33 consists of an expanded polypropylene (EPP) of a thickness ranging from 10 to 20 mm, although thickness may vary according to the needs. The use of EPP has the advantage of being lightweight in comparison to foam or foam-like material. A preferred material for the second soft inner liner 50 to 54 consists of a synthetic thermoplastic polymer such as polyvinyl chloride (PVC). The PVC liner has the advantage of being washable and of being non-absorbent. Alternatively, padding sections 31, 32, and 33 may be made of dual density foam having a hard back foam contacting helmet shell 20 and a softer foam layer contacting the wearer's head.

Referring to FIGS. 1–7*b*, front padding section 31 is generally rearwardly curved, so that it is adapted to accommodate the forehead of the wearer, and a portion of each side of the wearer's head. The top portion of front padding section 31 comprises a large opening 56 having a constriction 57 extending inwardly and defining a cavity or enclosure 55 in the front portion of opening 56. Opening 56 is shaped to loosely enclose at least the front portion of central padding section 32.

Central padding section 32 is generally adapted to accommodate the top of the wearer's head and as such is generally downwardly concave. Central padding section 32 is adapted to be movable in the longitudinal direction relative to helmet shell 20 and relative to adjacent padding sections 31 and 33. Central padding section 32 includes a front extension 61 comprising a wider end portion 59, which is larger than the constriction 57 of opening 56. Central padding section 32 is adapted to loosely conform to opening 56 of front padding section 31 and wider end portion 59 to conform loosely to the generally oversized correspondingly shaped cavity 55. In use, the shape constriction 57 of opening 56 and of the wider end portion 59 of the front extension 61 of the central padding section 32 serve as a motion-limiting means to restrict the relative longitudinal motion of central padding section 32 relative to front padding section 31. The abutment of the wider end portion 59 against constriction 57 prevents central padding section 32 from moving farther back than a predetermined position.

Figure 5:
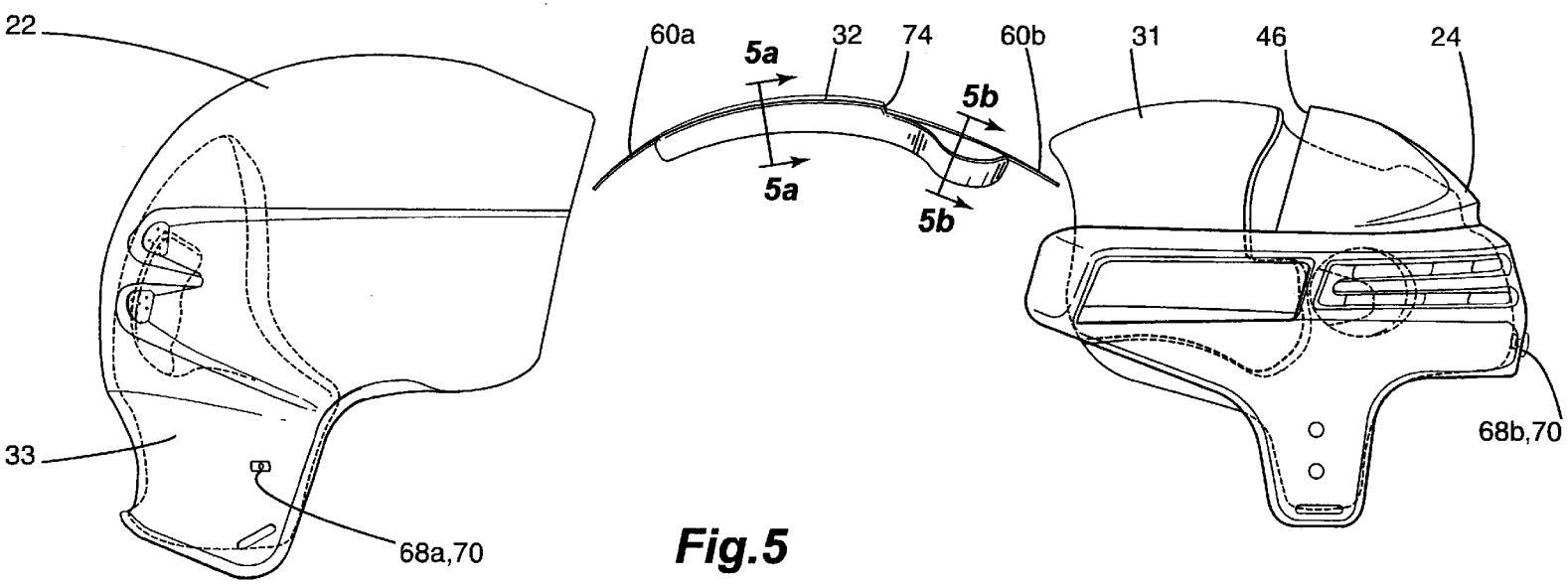
FIG. 5 is a side elevational view of the protective helmet shell disassembled showing in dotted lines the relative position of the inner shock absorbing pad assembly according to a first embodiment of the invention.
Figure 5B:
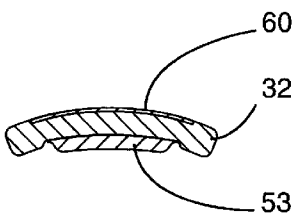
FIG. 5*b* is a cross sectional view of a central padding section of the inner shock absorbing pad assembly taken at line 5*b*—5*b* of FIG. 5.
Figure 5A:
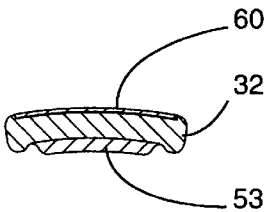
FIG. 5*a* is a cross sectional view of a central padding section of the inner shock absorbing pad assembly taken at line 5*a*—5*a* of FIG. 5.

Central section 32 further comprises a tongue 60 partially embedded in the upper surface of the foam material of padding section 32, the tongue protruding from both the front extension 61 and the rearward end 62 of padding section 32 to form a rear tongue 60*a* and a front tongue 60*b*. Rear padding section 33 is generally forwardly curved, so that it is adapted to accommodate the back of the wearer's head, the lower occipital region and a portion of each side of the back of the wearer's head. A portion 64 of rear padding section 33 is adapted to abut with rearward end 62 of central padding section 32. FIGS. 5*a* and 5*b* illustrate two cross-sectional views of central padding section 32. Tongue 60 is embedded into the padding material of central padding section 32 and soft padding liner 53 is glued or otherwise attached to the main padding material.

As illustrated in FIGS. 1–5 each padding section 31, 32 and 33 is provided with one or more ventilation apertures 66, which are generally aligned with air vents 38 in helmet shell 20 to permit airflow in and out of the protective helmet, to promote cooling of the wearer's head.

Front and rear padding sections 31 and 33 are fixedly retained to front and rear shell components 24, 22 by means of fasteners 68*a* which are embedded in each side of rear padding section 33, and fasteners 68*b* which are embedded into the front portion of front padding section 31. The fasteners extend outward, protrude from the surface of each respective pad assembly and are adapted to conform to mounting holes 70 in helmet shell 20. Fasteners 68 comprise a threaded hole adapted to receive a conventional threaded screw. Front and rear padding section 31 and 33 are thus secured inside their respective shells by threaded screws locking them in place yet are removable simply by undoing the threaded screws to permit removal of the padding sections 31 and 33. As shown in FIG. 5, in use, fasteners 68*a* and 68*b* are inserted into mating mounting holes 70 and secured With threaded screws. Front padding section 31(shown partially in dotted lines) is secured inside front shell components 24 and as can be seen, extends beyond the upper edge 46 of front shell component 24. Padding section 33 (in dotted lines) is secured inside rear shell component 22 and covers only the rear portion of shell component 22. When shell components 22 and 24 are assembled into a single unit, the exceeding padding section 31 also covers a portion of rear shell component 22 left uncovered as shown in FIGS. 7*a* and 7*b*.

Central padding section 32 is centrally located between front and rear padding sections 31 and 33 and is preferably not secured to the top wall portion 43 of helmet shell 20. Central padding section 32 is slidably connected to front and rear padding sections 31 and 33 by means of tongues 60*a* and 60*b* extending from each end 61 and 62. Tongues 60*a* and 60*b* are inserted in between front and rear padding sections 31 and 33 and helmet shell 20 and have a length sufficient to overlap a portion of front and rear padding sections 31 and 33. The front and rear padding sections 31 and 33 thereby retain central padding section 32 within the helmet shell 20, in the vicinity of top wall portion 43. As illustrated in FIGS. 7*a* and 7*b*, tongue 60*a* is inserted in a thin gap between rear shell component 22 and rear padding section 33 and similarly, tongue 60*b* is inserted in a thin gap between front shell component 24 and rear padding section 31. Front and rear padding sections 31 and 33 are preferably provided with thin channels 72 located on the top surface of each padding sections 31 and 33 having a shape generally corresponding to tongues 60*a* and 60*b*. Alternatively, channels 72 may be in the form of slots (not shown) within the thickness of each padding section 31 and 33 whereby tongues 60*a* and 60*b* are inserted into each slot and allowed to move.

In a preferred embodiment, tongue 60 forms the uppermost surface of central padding section 32 and is generally planar with a mild curvature as illustrated. Tongue 60 may be formed from any resilient material having sufficient rigidity to retain central padding section 32 in helmet shell 20. In a preferred embodiment, tongue 60 is made of a rigid plastic such as polypropylene, nylon, polycarbonate, and the like or combination thereof. Tongue 60 may be integrally formed with central padding section 32 by conventional injection moulding wherein tongue 60 is placed in a suitably shaped mould and a foamed polymer is injected therein. The polymer is permitted to cure into a rigid structure and the padding is removed from the mould. Alternatively, tongue 60 may be fastened to padding section 32 by means of conventional fastening systems such as screws, adhesives, hooks and loops and the likes.

Figure 7A:
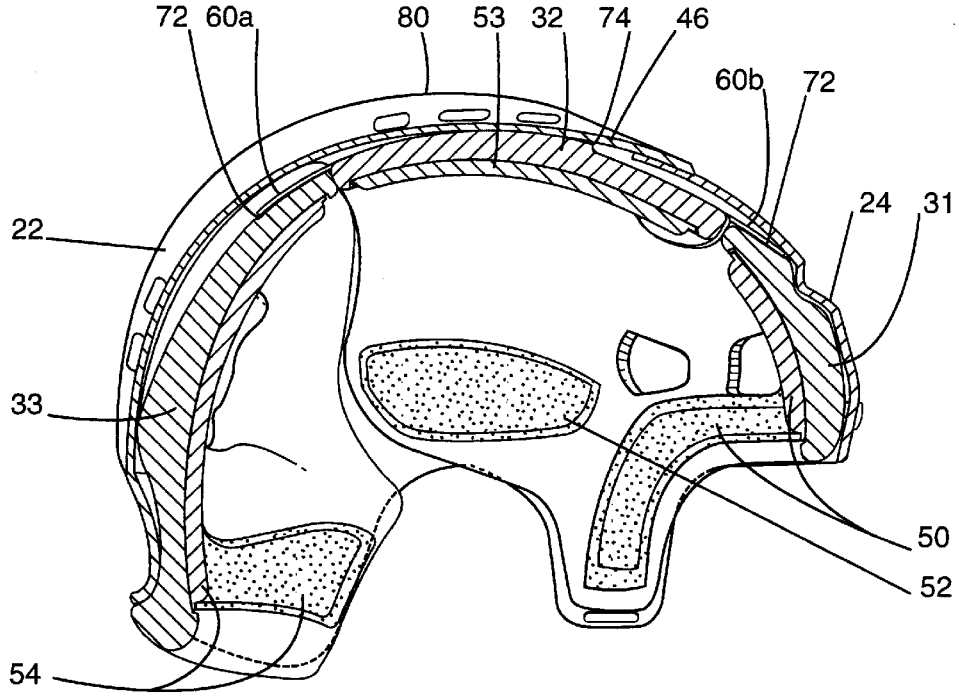
FIG. 7*a* is a cross-sectional view taken at line 7—7 of FIG. 6*a* showing the relative position of the inner shock absorbing pad assembly inside the protective helmet shell when the protective helmet shell is adjusted to its smallest setting according to a first embodiment of the invention.
Figure 7B:
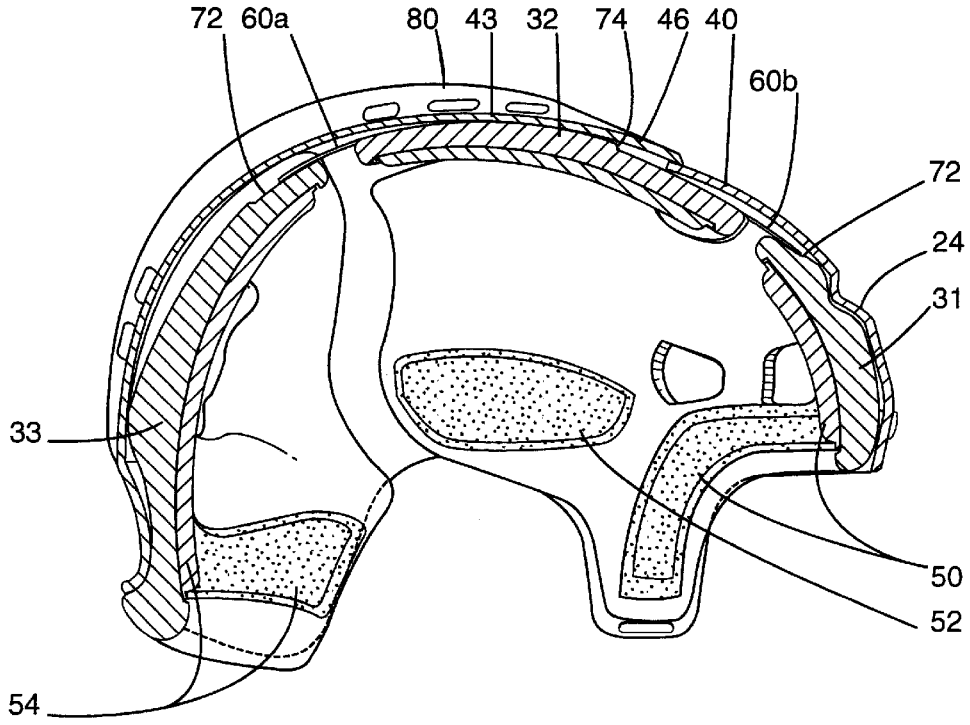
FIG. 7*b* is a cross-sectional view taken at line 7—7 of FIG. 6*b* showing the relative position of the inner shock absorbing pad assembly inside the protective helmet shell when the protective helmet shell is adjusted to its largest setting according to a first embodiment of the invention.

As illustrated specifically in FIGS. 1, 3, 5 and 7*a* and 7*b*, central padding section 32 comprises a small ridge portion 74 extending laterally across the uppermost surface of padding section 32 near its front extension 61. As best seen in FIGS. 7*a* and 7*b*, ridge 74 is located near the edge 46 of front shell component 24 and generally corresponds to the profile defined by the overlapping area of front shell component 24 and rear shell component 22 inside helmet shell 20. Ridge 74 is adapted to fill the small gap left behind the edge 46 of front shell component 24 of the overlapping area to prevent edge 46 from creating an area of concentration of forces during impact. Ridge 74 ensures that a wider area of the top surface of central padding section 32 is in contact or in close proximity with both front and rear shell components 24 and 22 so that an impact force in this general area will be transferred to a wide surface of padding material and therefore be more efficiently absorbed than if the top surface of central padding section 32 was continuous.

Figure 6A:
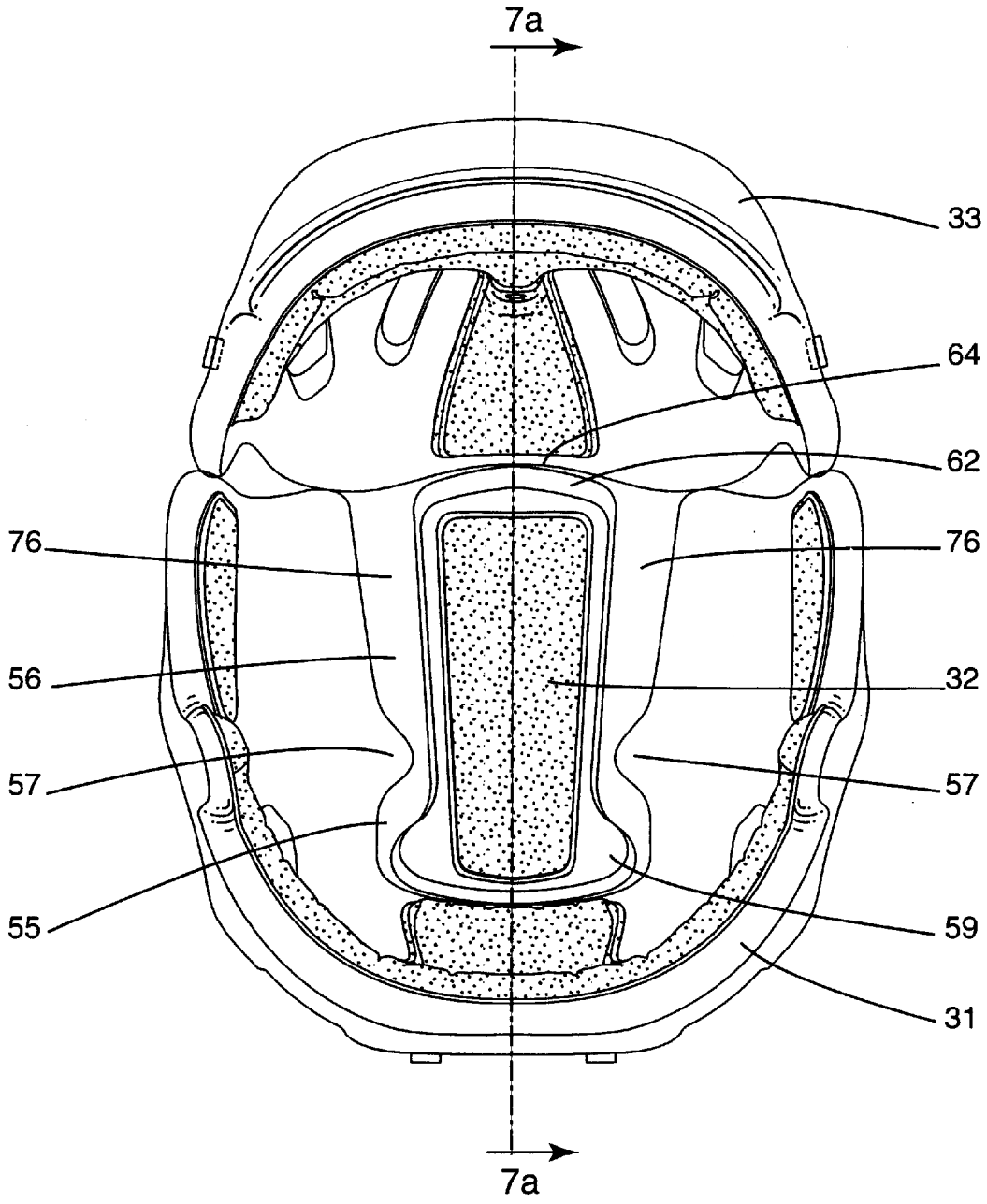
FIG. 6*a* is a bottom plan view of the relative position of the inner shock absorbing pad assembly when the protective helmet shell is adjusted to its smallest setting according to a first embodiment of the invention.
Figure 6B:
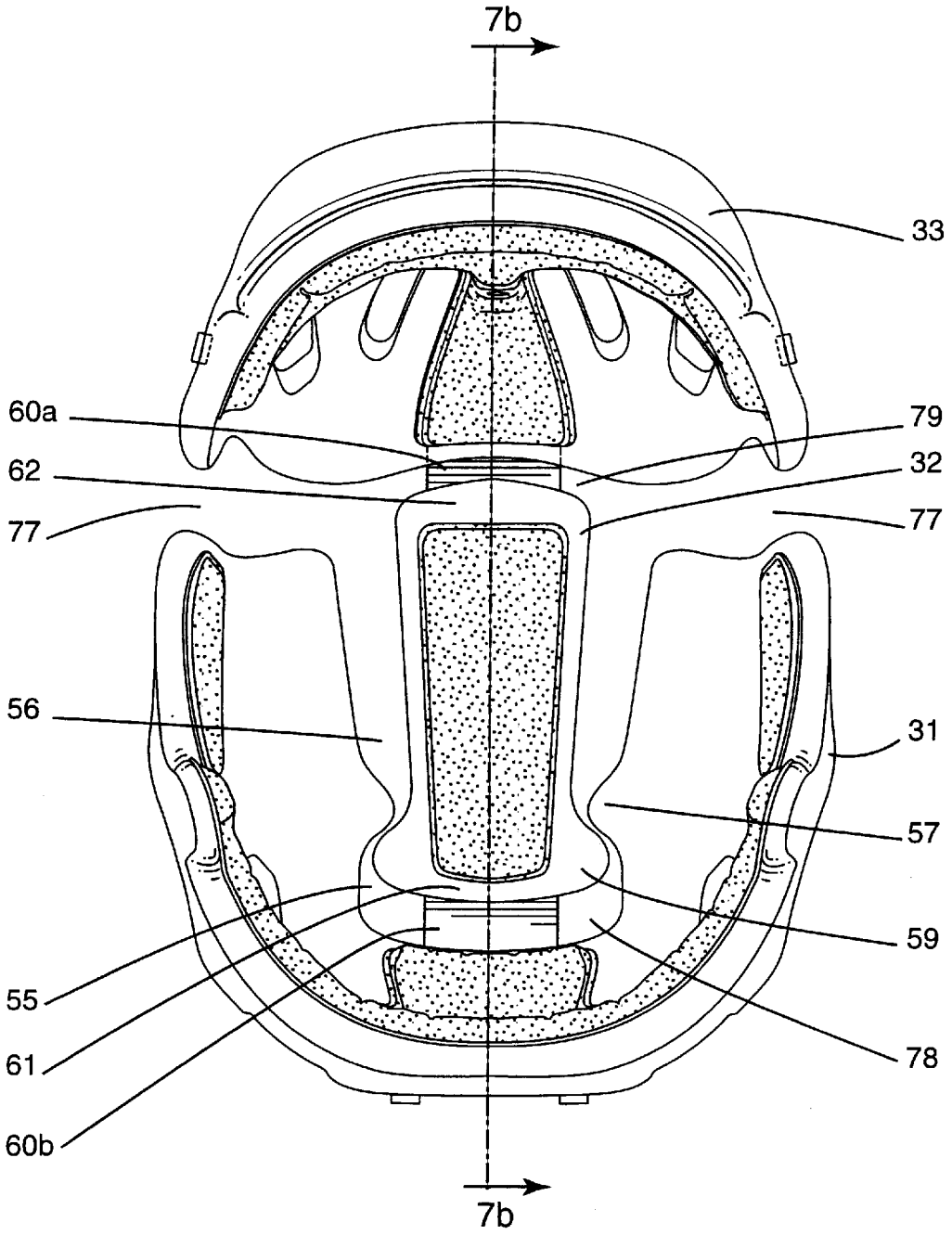
FIG. 6*b* is a bottom plan view of the relative position of the inner shock absorbing pad assembly when the protective helmet shell is adjusted to its largest setting according to a first embodiment of the invention.

Referring now to FIGS. 6*a* and 6*b* illustrating front, central and rear padding sections 31, 32 and 33 as installed in helmet shell 20. It can be seen that the main body of central padding section 32 is located within opening 56 of front padding section 31 and the wider end portion 59 of central padding section 32 is positioned forward of constriction 57 of opening: 56. FIGS. 6*a* and 7*a* illustrate front, central and rear padding sections 31, 32 and 33 cooperating together when helmet shell 20 is adjusted to its smallest setting. Wider end portion 59 abuts against the edge of front padding section 31 and rearward end 62 abuts against portion 64 of rear padding section 33 thereby covering the length of opening 56 between front and rear padding section 31 and 33, leaving only small gaps 76 on either side of central padding section 32 and no gaps between its ends 61 and 62 and the adjacent front and rear padding sections 31 and 33.

FIGS. 6*b* and 7*b* illustrate front, central and rear padding sections 31, 32 and 33 cooperating together when helmet shell 20 is adjusted to its largest setting. A nominal gap 77 is created between the sides of front and rear padding sections 31 and 33. Central padding section 32 has moved back to a central position opening two gaps 78 and 79 between its forward and rearward ends 61 and 62 and the adjacent front and rear padding sections 31 and 33. Wider end portion 59 has also moved back and is being blocked or stopped from further rearward movement by constriction 57. The cooperation of wider end portion 59 and constriction 57 prevents central padding section 32 from being displaced farther back which would leave a very small gap 79 and a much larger gap 78 between front and central padding section 31 and 32. Constriction 57 is positioned such that in cooperation with wider end portion 59, central padding section 32 is most likely to be centrally located when helmet shell 20 is adjusted to its largest setting. Central padding section 32 is free to move forward and narrow the forward gap 78 within cavity 55 but is prevented from moving back any further than constriction 57 thereby ensuring that the frontal top portion of the wearer's head is protected by the wider end portion 59 of central padding section 32, no matter where exactly the central padding section 32 ends up.

As can be seen specifically in FIGS. 1 and 7*b*, the top wall portion 40 of front shell component 24 is flat and even in order for the overlapping portions of front and rear shell components 22 and 24 to move unhindered between the small setting position (FIG. 7*a*) and the large setting position (FIG. 7*b*) whereas the top wall portion 43 of rear shell component 22 comprises a pair of elevated crest 80 extending from the forward edge of rear shell component 22 to the rear occipital region of rear shell component 22. Rear shell component 22 has therefore two lines of defense against an impact: A first line consisting of the elevated crests 80 which will bowl or deflect under a blow, and a second line of defense consisting of the flat and even top wall portion 43 in between and on both sides of the elevated crests 80. Since the top wall portion 40 of front shell component 24 provides a single line of defense against an impact force, it is important that front extension 61 of central padding section 32 remain in proximity of front padding section 31. The position of wider end portion 59 within cavity 55 of opening 56 ensures that the front extension of central padding section 32 limits the forward gap 78 to a maximum as is illustrated in FIG. 6*b* where the wider end portion 59 is abutting constriction 57. Therefore, the overall general shape of wider constriction 57 of opening 56 and the wider end portion 59 of front extension 61 ensures that the position of central padding section 32 is optimal for comfort and impact protection through the range of helmet size.

It must also be noted that whether in the small setting as illustrated in FIG. 6*a* or in the large setting as illustrated in FIG. 6*b*, the wider end portion 59 remains within the cavity 55 defined by opening 56 and the constriction 57 and as such afford almost the same protection in either setting.

Figure 8:
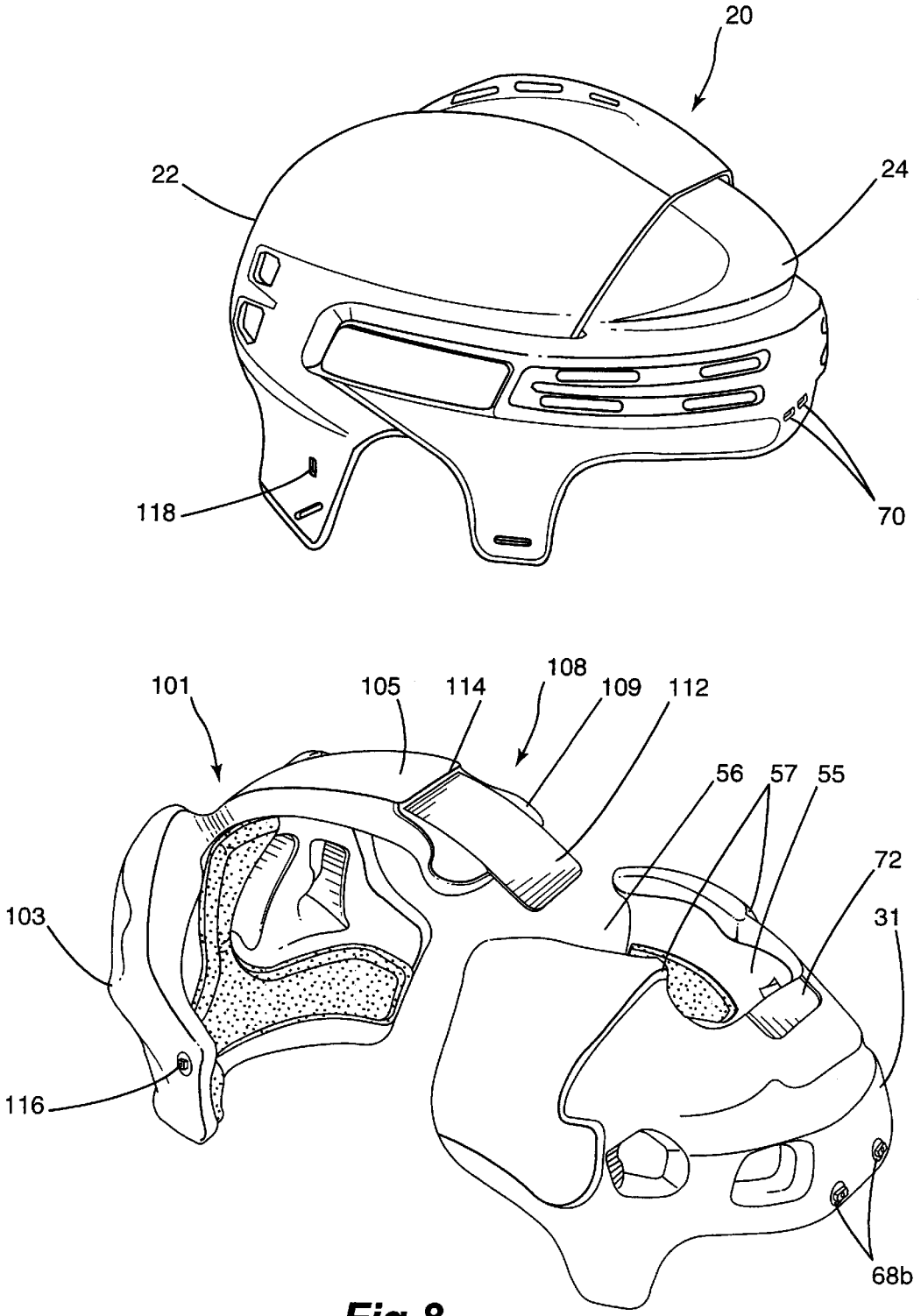
FIG. 8 is a perspective view of an adjustable protective helmet shell and its corresponding inner shock absorbing pad assembly in exploded view removed from the protective helmet shell according to a second embodiment of the invention.
Figure 9A:
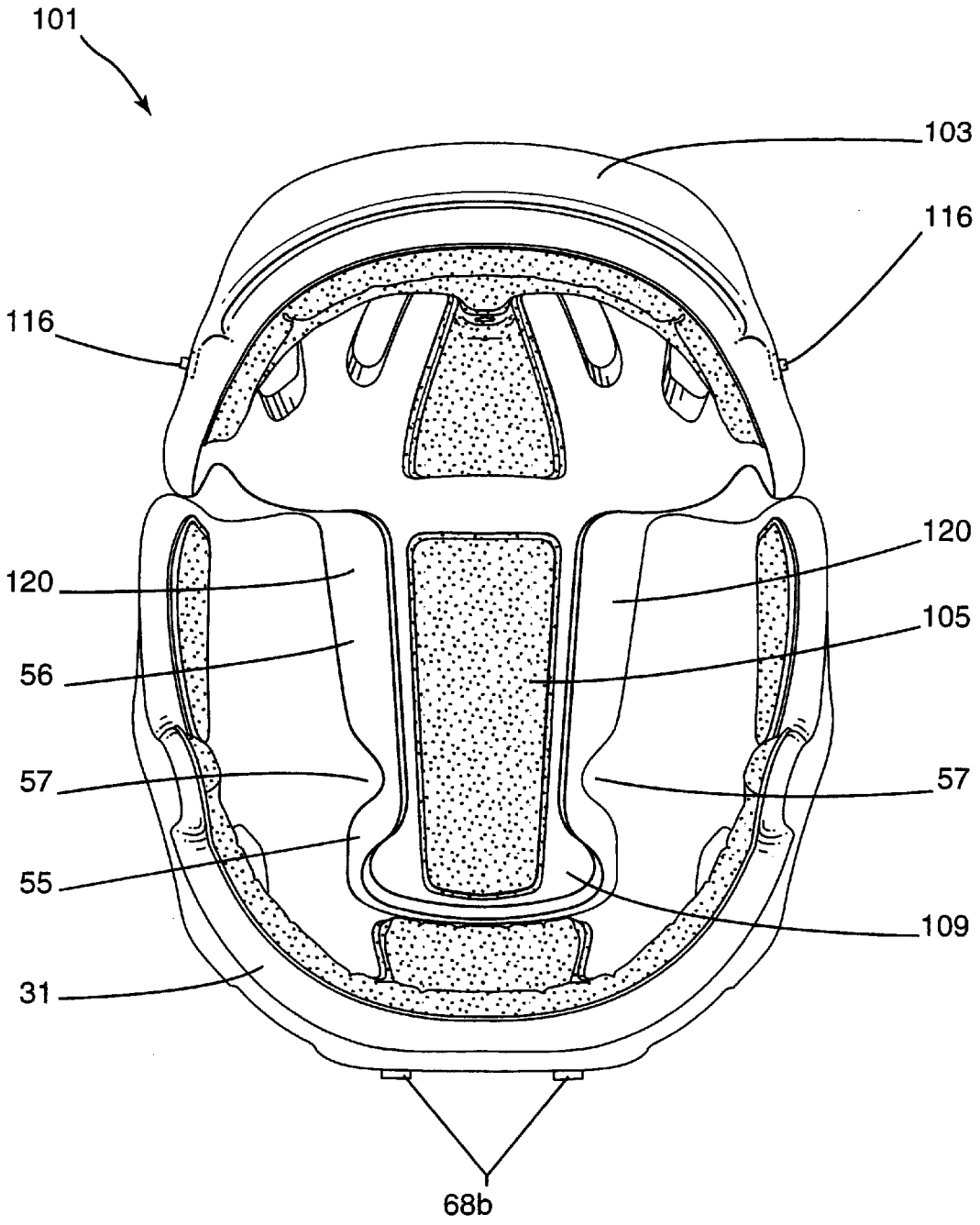
FIG. 9*a* is a bottom plan view of the relative position of the inner shock absorbing pad assembly when the protective helmet shell is adjusted to its smallest setting according to a second embodiment of the invention.
Figure 9B:
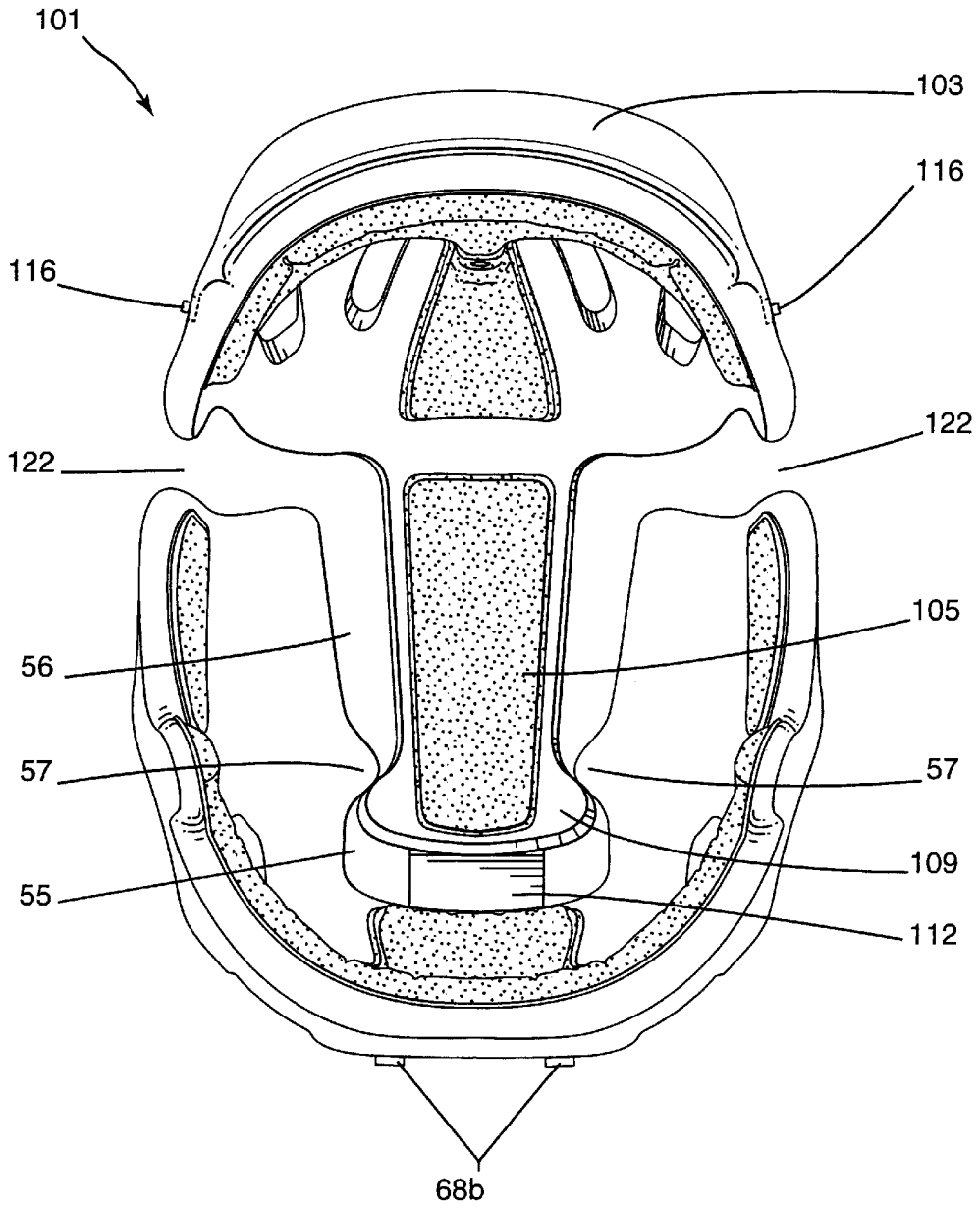
FIG. 9*b* is a bottom plan view of the relative position of the inner shock absorbing pad assembly when the protective helmet shell is adjusted to its largest setting according to a second embodiment of the invention.

FIGS. 8–9*b* illustrate a second embodiment of an absorbing pad assembly for an adjustable protective helmet. A similar helmet shell 20 is used, comprising a front shell component 24 and a rear shell component 22 interlocked together to form a protective helmet shell assembly 20 circumscribing the wearer's head. Front shell component 24 covers the forehead and a portion of the sides of a wearer's head, while rear shell component 22 covers the top, rear and a portion of the sides of a wearer's head. Front and rear shell components 22 and 24 are movable relative to one another as previously described. An identical front absorbing padding section 31 as previously described, is provided to cover the forehead and sides of the wearer's head which also comprises a large opening 56 in its upper portion. A single rear padding section 101 is provided comprising a rear portion 103 generally covering the rear of the wearer's head and an upper padding extension 105 extending forward from the central upper area of rear portion 103.

Upper padding extension 105 is generally adapted to accommodate the top of the wearer's head and as such is generally downwardly concave. The front end 108 of upper padding extension 105 comprises a wider end portion 109 adapted to loosely conform to the shape of cavity 55 within opening 56 of front padding section 31. Upper padding extension 105 further comprises a tongue 112 partially embedded in the upper surface of the foam material of upper padding extension 105, which when installed into helmet shell 20, will be inserted in a channel 72 on the upper surface of front padding section 31, in between front shell component 24 and front padding section 31. Upper padding extension 105 also comprises a ridge 114 extending laterally across its uppermost surface in order to fill the small gap left behind the overlapping area of front and rear shell 22 and 24 and prevent the edge of front shell component 24 from creating an area of concentration of forces during impact.

Front padding section 31 comprises fasteners 68*b* which are embedded into the front portion of front padding section 31, extend outwardly and protrude from the surface of front padding section 31. Fasteners 68*b* are adapted to conform to the mounting holes 70 in front shell 24. Fasteners 68*b* comprise a threaded hole adapted to receive a conventional threaded screw to secure front padding section 31 to helmet shell 20. Fasteners. 116 are embedded in each side of rear padding section 101 and also protrude from the surface of rear padding section 101. Fasteners 116 are adapted to fit into a corresponding generally vertical slot 118 located on each side of rear padding section 101. Fastener 116 may be positioned anywhere within slot 118 thereby providing a means of adjusting the internal position of rear padding section 101 in relation to helmet shell 20. Fastener 116 comprises a threaded hole adapted to receive a conventional threaded screw to secure rear padding section 101 to helmet shell 20. Fastener 116 may have a noncircular configuration, either square, rectangular or oval, which enables the user to tighten the conventional threaded screw without having to grip the inner portion of the fastener since the non-circular configuration will prevent rotation of fastener 116 within slot 118 while allowing it to move up and down inside slot 118. Front and rear padding section 31 and 101 are thus secured inside helmet shell 20 by threaded screws locking them in place yet are removable simply by undoing the threaded screws to permit removal of the padding sections 31 and 101.

Referring now to FIGS. 9*a* and 9*b* illustrating front and rear padding sections 31 and 101 as installed in helmet shell 20, it can be seen that the main body of upper padding extension 105 is located within opening 56 of front padding section 31 and the wider end portion 109 is positioned forward of the constriction 57 within cavity 55. FIG. 9*a* illustrates front and rear padding sections 31 and 101 cooperating together when helmet shell 20 is adjusted to its smallest setting. Upper padding extension 105 abuts against the edge of front padding section 31 thereby covering the length of opening 56 and leaving only small gaps 120 on either side of upper padding extension 105.

FIG. 9*b* illustrates front rear padding sections 31 and 101 cooperating together when helmet shell 20 is adjusted to its largest setting. A nominal gap 122 is created between front padding section 31 and rear portion 103 of rear padding section 101 on both sides of upper extension 105. In this setting, upper extension 105 has moved back to a central position opening a gap 124 at the front end of cavity 55 between wider end portion 109 and the adjacent front padding section 31. Wider end portion 109 has also moved back and is being blocked from further rearward movement by the constriction 57. The cooperation of wider end portion 109 and constriction 57 prevents upper extension 105 from being displaced farther back. Constriction 57 is positioned such that in cooperation with the wider end portion 59 of upper padding extension 105, they ensure a minimum of padding protection above the area defined by cavity 55. In use, when helmet shell 20 is adjusted by moving front and rear shell 22 and 24 relative to each other, fasteners 116 are loosened to allow rear padding section 101 some freedom of movement and some level of adjustability. The position of rear padding section 101 is adjustable within the range of the vertical slots 118. By moving fasteners 116 upwardly, rear portion 103 of rear padding section 101 is able to move upward and rotate forwardly about the fasteners 116 thereby allowing upper extension 105 to move forward. When wider end portion 109 abuts against the constriction 57 as shown in FIG. 9*b* , the size of helmet shell 20 may still be increased marginally because rear portion 103 will move upward while the wider end portion 109 of upper extension 105 remains pressed against constriction 57. In this small rotational movement of rear padding section 101, upper extension 105 remains in close proximity to the inner surface of helmet shell 20 as tongue 112 maintains the vertical position relative to helmet shell 20. This provision of adjustability of the position of rear padding section 101 relative to helmet shell 20 and consequently to front padding section 31 enables a marginally wider range of helmet size for this particular configuration of inner padding.

As in the first embodiment, whether in the small setting as illustrated in FIG. 9*a* or in the large setting as illustrated in FIG. 9*b*, the wider end portion 109 remains within the cavity 55 defined within opening 56 by constriction 57, and as such, afford almost the same comfort and protection in either setting.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. An adjustable protective helmet for sporting activities comprising a helmet shell for circumscribing the wearer's head, said helmet shell being made of a molded front shell component and of a molded rear shell component, each of said front and rear shell components having respective cooperating overlapping segments for connecting together said front and rear shell components to form said helmet shell; said front and rear shell components movable relative to one another in said overlapping segments to provide size adjustability of said protective helmet; said protective helmet including as a separate component a shock absorbing pad assembly retained inside said helmet shell; said pad assembly comprising at least two juxtaposed padding sections; one of said at least two padding sections comprising an opening; the other of said at least two padding sections comprising an extension loosely fitting within said opening and shaped to allow relative longitudinal motion between said at least two juxtaposed padding sections; said at least two juxtaposed padding sections comprising motion-limiting means to limit said relative longitudinal motion and control the position of said extension relative to said opening.

2. An adjustable protective helmet as defined in claim 1 wherein said motion-limiting means comprises abutment of a portion of said extension with a portion of said opening.

3. An adjustable protective helmet as defined in claim 2 wherein said extension comprises a wider end portion and said opening comprises a constriction which confines said wider end portion to said opening.

4. An adjustable protective helmet as defined in claim 3 wherein one of said at least two padding sections is a front padding section fixedly retained against displacement relative to said front shell component; said front padding section comprising said opening.

5. An adjustable protective helmet as defined in claim 4 wherein said extension comprises a tongue protruding from at least one end of said extension, said tongue having a length sufficient to overlap a portion of an adjacent padding section.

6. An adjustable protective helmet as defined in claim 5 wherein said adjacent padding section comprises a channel adapted to receive said tongue.

7. An adjustable protective helmet as defined in claim 5 comprising a central padding section and a rear padding section, said central padding section having a front end and a rear end, wherein said front end of said central padding section comprises said extension for fitting within said opening of said front padding section.

8. An adjustable protective helmet as defined in claim 7 wherein said central padding section is located between said front and rear padding section and comprises a second tongue protruding from said rear end of said central padding section, said rear end adapted to abut against said rear padding section, said second tongue having a length sufficient to overlap a portion of said rear padding section.

9. An adjustable protective helmet as defined in claim 8 wherein said central padding section further comprises a ridge adapted to conform to said overlapping segment of said molded front and rear shell components.

10. An adjustable protective helmet as defined in claim 9 wherein said rear padding section is fixedly retained against displacement relative to said rear shell component; said central padding section adapted for relative longitudinal motion within boundaries defined by the shape of said opening and said extension.

11. An adjustable protective helmet as defined in claim 10 further comprising soft add-on padding sections positioned onto the inner facing surfaces of at least one of said front, rear and central padding section.

12. An adjustable protective helmet as defined in claim 11 wherein said front and rear padding sections comprise attachment means adapted to secure said front and rear padding sections to said front and rear shell components respectively.

13. An adjustable protective helmet as defined in claim 5 further comprising a rear padding section wherein said extension is integral with said rear padding section and extends forwardly from an upper area of said rear padding section.

14. An adjustable protective helmet as defined in claim 13 wherein said rear padding section is adjustably retained against displacement relative to said rear shell component.

15. An adjustable protective helmet for sporting activities comprising a helmet shell for circumscribing the wearer's head, said helmet shell made of a molded front shell component and a molded rear shell component, each shell component having respective cooperating overlapping segments for connecting together said front and rear shell components to form said helmet shell; said shell components movable relative to one another in said overlapping segments to provide size adjustability of said protective helmet; said protective helmet including a shock absorbing pad assembly inside said helmet shell; said pad assembly comprising a front padding section, a rear padding section and a central padding section positioned between said front and rear padding sections; said front padding section comprising an opening in an upper portion of said front padding section; said central padding section comprising an extension loosely fitting within said opening and shaped to allow relative longitudinal motion between said front and central padding sections; and said front and central padding sections comprising motion-limiting means to limit said relative longitudinal motion and control the position of said central padding section relative to said said front and rear padding sections.

16. An adjustable protective helmet as defined in claim 15 wherein said motion-limiting means comprises abutment of a portion of said extension with a portion of said opening.

17. An adjustable protective helmet as defined in claim 16 wherein wherein said extension comprises a wider end portion and said opening comprises a constriction which confines said wider end portion to said opening.

18. An adjustable protective helmet as defined in claim 17 wherein said central padding section further comprises a tongue means protruding from both a forward end and a rearward end of said central padding section, said tongue means having a length sufficient to overlap a portion of said front and rear padding sections.

19. An adjustable protective helmet as defined in claim 18 wherein said front and rear padding sections comprise a channel adapted to receive said tongue means.

20. An adjustable protective helmet as defined in claim 19 wherein said motion-limiting means is located substantially in the area of said overlapping segments of said helmet shell.

21. An adjustable protective helmet as defined in claim 15 wherein said padding sections are made of expanded polypropylene.

22. An adjustable protective helmet as defined in claim 15 wherein said padding sections are made of dual density foam having a hard back foam contacting said helmet shell and a softer foam contacting the wearer's head.

* * * * *